US006180579B1

(12) United States Patent
Erilli et al.

(10) Patent No.: US 6,180,579 B1
(45) **Date of Patent: *Jan. 30, 2001**

(54) HIGH FOAMING, GREASE CUTTING LIGHT DUTY LIQUID DETERGENT COMPRISING ETHER CARBOXYLATES AND AMINE OXIDES

(75) Inventors: Rita Erilli, Liege; Chantal Gallant, Cheratte, both of (BE)

(73) Assignee: Colgate-Palmolive Co., Piscataway, NJ (US)

( * ) Notice: Under 35 U.S.C. 154(b), the term of this patent shall be extended for 0 days.

This patent is subject to a terminal disclaimer.

(21) Appl. No.: 09/549,394

(22) Filed: Apr. 14, 2000

(51) Int. Cl.[7] ..... C11D 17/00

(52) U.S. Cl. ..... 510/235; 510/424; 510/426; 510/499; 510/505; 510/508

(58) Field of Search ..... 510/424, 426, 510/499, 235, 505, 508

(56) References Cited

U.S. PATENT DOCUMENTS 5,962,396 * 10/1999 Pollack et al. ..... 510/433
6,004,920 * 12/1999 Pollack et al. ..... 510/426
6,051,542 * 4/2000 Pollack et al. ..... 510/426

* cited by examiner

*Primary Examiner*—Necholus Ogden
(74) *Attorney, Agent, or Firm*—Richard E. Nanfeldt

(57) ABSTRACT

A light duty, liquid comprising: a paraffin sulfonate, an alpha olefin sulfonate, an ethoxylated alkyl ether sulfate, an amine oxide or ether carboxylide surfactant, a magnesium containing inorganic compound, and water.

6 Claims, No Drawings

HIGH FOAMING, GREASE CUTTING LIGHT DUTY LIQUID DETERGENT COMPRISING ETHER CARBOXYLATES AND AMINE OXIDES

BACKGROUND OF THE INVENTION

The present invention relates to novel light duty liquid detergent compositions with high foaming and good grease cutting properties.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or diethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid detergent properties can be formulated with a paraffin sulfonate, ethoxylated alkyl ether sulfate surfactant, an alpha olefin sulfonate, a surfactant selected from the group consisting of ether carboxylates and amine oxide surfactants and mixtures thereof, magnesium ions and water.

Accordingly, one object of this invention is to provide novel, high foaming, light duty liquid detergent compositions containing an alpha olefin sulfonate surfactant.

To achieve the foregoing and other objects and in accordance with the purpose of the present invention, as embodied and broadly described herein the novel, high foaming, light duty liquid detergent of this invention comprises an alpha olefin sulfonate, ethoxylated alkyl ether sulfate surfactant, a surfactant selected from the group consisting of ether carboxylates and amine oxides surfactants and mixtures thereof, magnesium ions and water wherein the composition does not contain an alkyl benzene sulfonate surfactant, a glycol ether solvent, an ethoxylated and/or propoxylated nonionic surfactant, a zwitterionic surfactant, a mono- or di-saccharides a polyoxyalkylene glycol fatty acid, a builder, a polymeric thickener, an acid, a clay, a fatty acid alkanol amide, abrasive, silicas, tricloscan, alkaline earth metal carbonates, alkyl glycine surfactant, cyclic imidinium surfactant, or more than 0.2 wt. % of a perfume or water insoluble hydrocarbon other than trichlorocarbanilibe.

DETAILED DESCRIPTION OF THE INVENTION

The present invention relates to a light duty liquid detergent which comprises approximately by weight:

(a) 12% to 30% of a paraffin sulfonate surfactant;

(b) 0.5% to 5% of an ethoxylated alkyl ether surfactant;

(c) 2% to 30% of an alpha olefin sulfonate surfactant;

(d) 0.5% to 5% of at least one surfactant selected from the group consisting of ether carboxylates and amine oxides surfactants and mixtures thereof;

(e) 1% to 5.5% of magnesium containing inorganic compound;

(f) 0.5% to 6% of a $C_1$–$C_3$ alkanol; and (g) the balance being water wherein the composition does not contain a glycol ether solvent, an ethoxylated and/or propoxylated nonionic surfactant, a zwitterionic surfactant, an alkyl benzene sulfonate surfactant, a polyoxyalkylene glycol fatty acid, a mono- or di-saccharides, a builder, a polymeric thickener, an acid, a clay, a fatty acid alkanol amide, abrasive, silicas, triclosan, alkaline earth metal carbonates, alkyl glycine surfactant, cyclic imidinium surfactant, or more than 0.3 wt. % of a perfume or water insoluble hydrocarbon other than trichlorocarbanilibe.

The $C_{12}$–$C_{20}$ paraffin sulfonates used at a concentration of 12 wt. % to 30 wt. %, more preferably 14 wt. % to 28 wt. % in the instant compositions may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744 and 3,372,188 and also in German Patent 735,096. Such compounds may be made to specifications and desirably the content of paraffin sulfonates outside the $C_{14-17}$ range will be minor and will be minimized, as will be any contents of di- or poly-sulfonates.

The present invention also contains 2 wt. % to 30 wt. %, more preferably 8 wt. % to 24 wt. % of an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treat to convert the sultones to sulfonates. Preferred alpha olefin sulfonates contain from 14 to 16 carbon atoms in the R alkyl group and are obtained by sulfonating an a-olefin.

The $C_{8-18}$ ethoxylated alkyl ether sulfate surfactants have the structure $R{-}(OCHCH_2)_nOSO_3M$ wherein n is about 1 to about 22 more preferably 1 to 3 and R is an alkyl group having about 8 to about 18 carbon atoms, more preferably 12 to 15 and natural cuts, for example, $C_{12-14}$; $C_{12-15}$ and M is an ammonium cation or an alkali metal cation, most preferably sodium. The $C_8$–$C_{18}$ ethoxylated alkyl ether sulfate surfactant is present in the composition at a concentration of about 0.5 to about 8.0 wt. %, more preferably about 1.0 to 7.0 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule also are suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

The ether carboxylates which can be used in the instant compositions are depicted by the formula:

$$CH_3(CH_2)_{10}CH_2(OCH_2CH_2)_nOCH_2COONa$$

wherein n is a number from 3 to 12, preferably 6 to 12 and most preferably 10.

The amine oxides which can be used in forming the light duty liquid compositions are depicted by the formula:

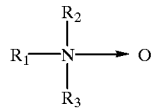

wherein $R_1$ is a $C_{10}$–$C_{18}$ a linear or branched chain alkyl group, $R_2$ is a $C_1$–$C_{16}$ linear alkyl group and $R_3$ is a $C_1$–$C_{16}$ linear alkyl group, or the amido radical:

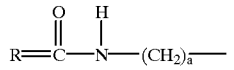

wherein R is an alkyl group having about 9 to 19 carbon atoms and a is the integer 1 to 4: $R_2$ and $R_3$ are each alkyl groups having 1 to 3 carbons and preferably 1 carbon;

The magnesium inorganic compound used at a concentration of 0.25 wt. % to 3 wt. %, more preferably 0.5 wt. % to 2 wt. % of the instant composition is a magnesium oxide, sulfate or chloride. The magnesium salt or oxide provides several benefits including improved cleaning performance in dilute usage, particularly in soft water areas. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

The water is present at a concentration of 40 wt. % to 83 wt. %.

The magnesium inorganic compound used at a concentration of 1 wt. % to 5.5 wt. %, more preferably 1.5 wt. % to 4.5 wt. % of the instant composition is a magnesium oxide, sulfate or chloride. The magnesium salt or oxide provides several benefits including improved cleaning performance in dilute usage, particularly in soft water areas. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

The water is present at a concentration of 26 wt. % to 86 wt. %.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a perservative at a concentration of 0.1 to 4.0 wt. %. Other preservatives are dibromodicyanobutane, citric acid, benzylic alcohol and poly (Hexamethylene) biguanidium hydrochloride and mixtures thereof. Sodium bisulfite can be used as a color stabilizer at a concentration of 0.01 to 0.2 wt.

The present light duty liquid detergents such as dishwashing liquids are readily made by simple mixing methods from readily available components which, on storage, do not adversely affect the entire composition. Solubilizing agent such as ethanol, sodium chloride and/or sodium xylene or sodium xylene sulfonate are used to assist in solubilizing the surfactants. A preferred solubilizing system is about 0.5 to 6.0 wt. % of a $C_1$–$C_3$ alkanol such as ethanol and 0 to 2 wt. %, more preferably 0.1 to 1.5 wt. % of urea. The viscosity of the light duty liquid composition desirably will be at least 100 centipoises (cps) at room temperature, but may be up to 1,000 centipoises as measured with a Brookfield Viscometer using a number 21 spindle rotating at 20 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is substantially neutral to skin, e.g., 4.5 to 8 and preferably 5.0 to 7.0. The pH of the composition can be adjusted by the addition of $Na_2O$ (caustic soda) to the composition.

The instant compositions have a minimum foam volume of 300 mls after 40 rotation at 25° C. as measured by the foam volume test using 0.033 wt. % of the composition in 150 ppm of water. The foam test is an inverted cylinder test in which 100 ml. of a 0.033 wt. % LDL formula in 150 ppm of $H_2O$ is placed in a stoppered graduate cylinder (500 ml) and inverted 40 cycles at a rate of 30 cycles/minute. After 40 inversions, the foam volume which has been generated is measured in mls inside the graduated cylinder. This value includes the 100 ml of LDL solution inside the cylinder.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

EXAMPLE 1

The following formulas were prepared at room temperature by simple liquid mixing procedures as previously described

| | 1 | 2 |
|---|---|---|
| C14–17 paraffin sulfonate | 24.5 | 24.5 |
| Ethoxylated C12-C14 alkyl ether sulfate 2EO | 3.50 | 3.50 |
| C14–16 alpha olefin sulfonate | 3.50 | 3.50 |
| Cocoamido propyl dimethyl amine oxide | 0.00 | 3.51 |
| Ether carboxylate | 1.05 | |
| MgSO4. 7H2O | 4.58 | 4.58 |
| Perfume | 0.20 | 0.20 |
| Preservative[1] | 0.01 | 0.01 |
| Urea | 0.00 | 0.00 |
| Ethanol | 1.00 | 4.00 |
| Appearance | liq | liq |
| Miniplates | | |
| 300 ppm | 41 | 51 |
| 50 ppm | 34 | 47 |
| Gardner° | | |
| 300 ppm | 1 | 4 |
| 50 ppm | 9 | 1 |
| Foam test | | |
| 50 ppm | 300 ml | |
| 300 ppm | 360 ml | |

°positive difference versus a current PS/AEOS technology
[1]Preservative is Myacid BT: 2 bromo2-nitropopane-1.3 diol

What is claimed is:

1. A light duty liquid detergent composition comprising approximately by weight:

(a) 12% to 30% of a $C_{10}$–$C_{20}$ paraffin sulfonate;

(b) 2% to 30% of an alpha olefin sulfonate;

(c) 0.5% to 5% of an ethoxylated alkyl ether sulfate;

(d) 0.5% to 5% of at least one surfactant selected from the group consisting of ether carboxylates and amine oxide surfactants and mixtures thereof;

(e) 1% to 5.5% of a magnesium containing inorganic compound; and (f) the balance being water, wherein the composition does not contain more than 0.2 wt. % of a water insoluble hydrocarbon.

2. A light duty liquid composition according to claim 1 which includes, in addition, 1% to 6% by weight of a solubilizing agent which is a $C_1$–$C_3$ alkanol.

3. A light duty liquid composition according to claim 1 further including a preservative.

4. A light duty liquid composition according to claim 1 further including a color stabilizer.

5. A light duty liquid cleaning composition according to claim 1 wherein said magnesium containing inorganic compound is magnesium sulfate.

6. A light duty liquid composition according to claim 2 further including urea.

* * * * *